United States Patent [19]

Völlinger et al.

[11] 4,154,108

[45] May 15, 1979

[54] HAND PIPETTE

[75] Inventors: Peter Völlinger, Neustadt; Klaus Käser, Weinsberg; Adolf Hirschmann, Heilbronn, all of Fed. Rep. of Germany

[73] Assignee: Labora Mannheim GmbH, Mannheim, Fed. Rep. of Germany

[21] Appl. No.: 885,951

[22] Filed: Mar. 13, 1978

[30] Foreign Application Priority Data

Mar. 15, 1977 [DE] Fed. Rep. of Germany ..... 2711124

[51] Int. Cl.[2] ..... B01L 3/02

[52] U.S. Cl. ..... 73/425.6

[58] Field of Search ..... 73/425 HP, 425.6; 222/309, 326, 327

[56] References Cited

U.S. PATENT DOCUMENTS 3,815,790 6/1974 Allen ..... 73/425.6 X

*Primary Examiner*—S. Clement Swisher

*Attorney, Agent, or Firm*—Woodard, Weikart, Emhardt & Naughton

[57] ABSTRACT

The present invention is concerned with a hand pipette with a piston arrangement which is forced upwardly by an elastic force, the piston of which is displaceable in a removable pipette tip and the piston rod of which can be displaced downwardly against the elastic force by external operation to such an extent that the piston, at the lower end of the piston stroke, is at the lower end of the pipette tip, the lower end of the pipette being provided with a holding ring through which the piston rod passes and which carries the removable pipette tip at the bottom of the holding ring and at the top is mounted so as to be axially displaceable and lockable.

7 Claims, 13 Drawing Figures

HAND PIPETTE

BACKGROUND OF THE INVENTION

In the case of such hand pipettes, according to German Pat. No. 2,456,049, the lower receiving end of the pipette housing carries a tube in which is axially, displaceably arranged a holding ring. Locking takes place by means of a setcrew which is screwed in through the wall of the holder ring against the tube of the reception end. A setscrew locking type of pipette is also disclosed in U.S. Pat. No. 3,815,790.

The problem with which the present invention is concerned is to make superfluous the use of a tool (screw driver) in the case of a hand pipette of the type mentioned initially and, furthermore, to achieve a more dependable clamping action than is possible in the case of the use of a setscrew.

Thus, according to the present invention, there is provided a hand pipette with a piston arrangement which is forced upwardly by an elastic force, the piston of which is displaceable in a pipette tip and the piston rod of which can be displaced donwardly against the elastic force by external operation to such an extent that the piston, at the lower end of the piston stroke, is at the lower end of the pipette being provided with a holding ring through which the piston rod passes and which carries a removable pipette tip at the bottom and at the top is mounted so as to be axially displaceable and lockable, wherein the top of the holding ring carries a tube which passes through an axial bore of the lower reception end of the pipette housing and on its free upper end, in a widened space of said reception end, carries an eccentric with a related eccentric axis, the wall of said widened space of said reception end, carries an eccentric with a related eccentric axis, the wall of said widened space lying eccentrically to the axis of the pipette arrangement as a whole in such a manner that rotation of the holding ring brings about a clamping of the eccentric with the surrounding wall of said widened space.

With this construction, there is achieved a locking of the cylindrical pipette tip in the position in which it sits snugly with the piston standing in the discharge position simply by rotating the holding ring, whereby, without axial displacement, the clamping between the eccentric, on the one hand, and the eccentric wall of the widened space, on the other hand, is achieved. This mode of construction renders the use of a tool superfluous. Furthermore, by means of the clamping action of the eccentric in the widened space, a better locking is achieved than in the case of the screwing method described in German Pat. No. 2,456,049.

The cylindrical pipette tip is advantageously detactably held on the holding ring by means of a bayonet joint. The direction of rotation by means of which insertion into the bayonet joint is achieved should coincide with the direction of rotation in which the clamping of the eccentric is also achieved.

The adjustment of various pipetting volumes is advantageously accomplished by means of a known type of stepped distance piece. In a construction of this type, the piston rod is held in an inner collar and advantageously this inner collar is displaceable in a tubular stepped distance piece provided with radial steps with which there co-operates a stop pin projecting radially out of the inner collar for limiting the stroke, the steps of the distance piece limiting the upper end of the piston stroke. However, in the case of the construction described in U.S. Pat. No. 3,766,785, the steps of the distance piece limit the lower end of the piston stroke, which impairs the exactitude of the pipetting procedure.

In the construction described in this U.S. Pat. No. 3,766,785, by rotation on the upper projecting end of the the inner collar, the stop pin is coordinated with various steps of the distance piece. In order, in such a construction, to achieve a locking of the hand pipette at an adjusted pipetting volume, it is advantageous to provide on the inner collar at least one outwardly spring loaded, non-rotatable projection which engages in various inner longitudinal grooves of the distance piece, i.e., by rotating on the upper projecting end of the inner collar, on the one hand the stop pin is coordinated with various steps of the distance piece and on the other hand, the spring-loaded projection engages into an associated inner longitudinal groove of the distance piece so that during use the pipette volume remains unchanged.

According to an especially simple construction of such a spring-loaded projection, the inner collar is provided with a non-rotatable end piece on which is a non-rotatable tubular elastic body which has two elastic, oppositelylying flanges, each of which engages in a longitudinal groove. The tubular elastic body preferably comprises two spring-leaf profiles, the side edges of which are bevelled and engage in longitudinal slots of the end piece and the middle parts of which are raised in such a manner that they form the flanges. When the upper projecting end of the inner collar is rotated in order to associate the stop pin with various steps of the distance piece, then the inner collar, in the case of rotating over the end piece, takes with it the two spring-leaf profiles and these are elastically pressed together when the flanges are forced out of a longitudinal groove by the rotation; if the flanges engage into the next longitudinal groove, then the spring-leaf profiles again elastically assume their original shape.

The present invention will now be explained in more detail, with reference to the accompanying drawings.

DESCRIPTION OF THE PREFERRED EMBODIMENT

Figure 1:
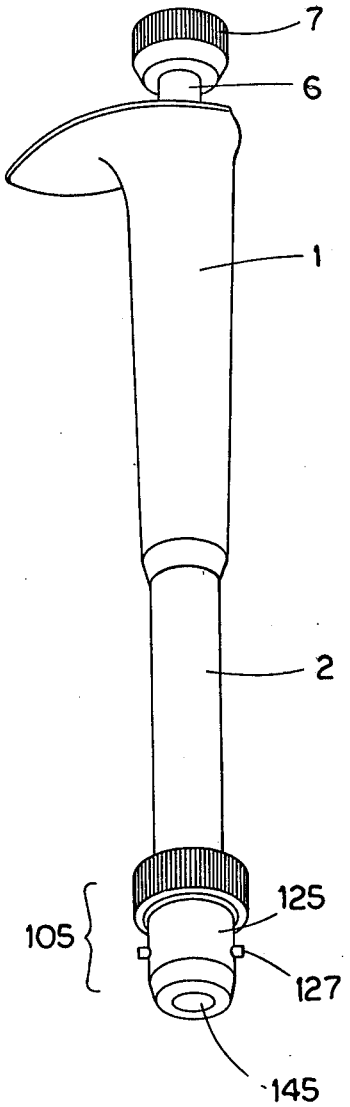
FIG. 1 is a perspective view of a hand pipette without the pipette tip attached.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

As can be seen from FIG. 1, a pipette housing 2 press sits in a handle 1. In this is displaceably and rotatably arranged an inner collar 6:

(a) Axial displacement of the inner collar 6 brings about the indrawing stroke or the delivery stroke, as will be explained hereinafter in more detail with reference to FIG. 4.

(b) Furthermore, axial displacement of the inner collar 6 operates the ejection and holding mechanism for a piston rod 23, as will be explained hereinafter in more detail with reference to FIGS. 5 and 6.

(c) Rotation of the inner collar 6 in the pipette housing 2 permits the adjustment of various stroke volumes and also attaining of the position serving for the ejection of the piston rod 23, as will be explained hereinafter in more detail with reference to FIG. 4.

(d) The upper end of the inner collar 6 carries a milled push button 7 in order to be able to carry out the described operations.

(e) The lower end of the pipette housing 2 has a reception end 111 (FIG. 7) with a holding ring 105 (FIGS. 1 and 7), the axially displaceable and lockable arrangement of which will be explained hereinafter in more detail with reference to FIG. 7.

A pipette tip 107 according to the present invention (see FIG. 2) has, on its upper end, a reception region 135, a hollow cylindrical region 121 and, connected thereto, a converging end region 101 which terminates in a narrow indrawing and discharge opening 103.

Figure 3:
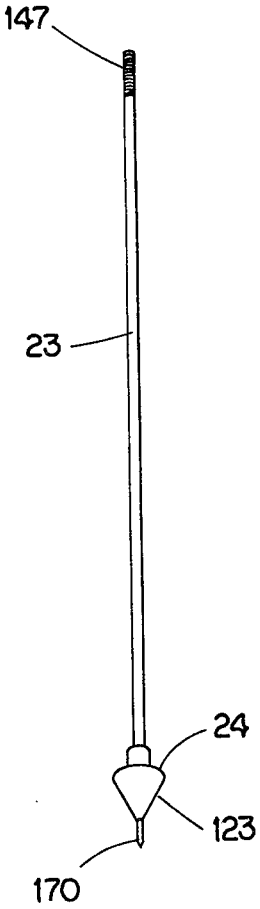
FIG. 3 is a perspective view of the piston unit.

FIG. 3 shows a piston arrangement, comprising a piston rod 23 with a piston 24 on the lower end thereof. The maximum circular diameter of the piston 24 is the same as or, advantageously, somewhat greater than the inner diameter of the hollow cylindrical region 121 of the pipette tip 107 so that the piston 24 lies slidingly during the whole stroke against the cylindrical inner wall of the region 121.

The lower surface 123 of the piston 24 has a conical shape which fits snugly into the correspondingly conically-shaped converging region 101 of the pipette tip, thus ensuring a complete forcing out of the liquid contents of the pipette tip in the discharge stroke.

The conically-shaped lower surface 123 of the piston 24 advantageously carries a prolongation 170 which can extend through the indrawing and discharge opening 103 of the pipette tip 107, thus ensuring a complete discharge of liquid even in the region of the indrawing and discharge opening.

For the assembly of the three individual parts illustrated in FIGS. 1 and 3, the piston unit illustrated in FIG. 3 is a first pushed through a central opening 145 in the holding ring 105 and held axially non-displaceably in the pipette. For this purpose, the piston unit can be screwed by means of a thread formed in the portion 147 (see FIG. 3) on the upper end of the piston rod 23 into a corresponding thread in the inner collar 6 or into a part securely attached to this inner collar 6. However, this construction has the disadvantage that in order to screw out the piston unit shown in FIG. 3, the piston 24 or the piston rod 23 must be gripped, which can be hygienically objectionable if the piston 24 and/or the piston rod 23 has come into contact with, for example, poisonous liquids or with liquids contaminated with pathogenic materials. Therefore, it is advantageous not to use a screw connection but rather the clamping and ejection mechanism described hereinafter in more detail with reference to FIGS. 5 and 6.

Figure 2:
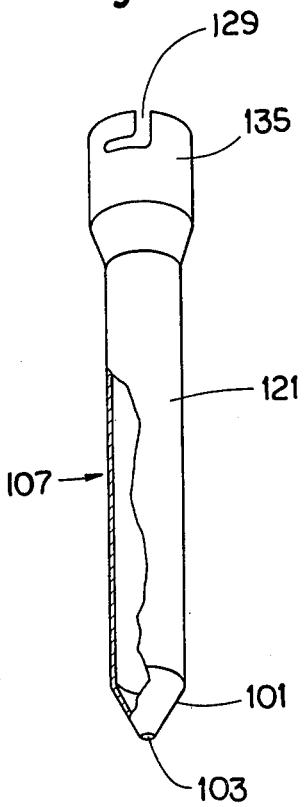
FIG. 2 is a perspective view of the pipette tip, partly in section.

After the insertion of the piston unit illustrated in FIG. 3 into the pipette body illustrated in FIG. 1, the pipette tip 107 illustrated in FIG. 2 is applied to the holding ring 105 by means of a bayonet joint comprising two slots 129 and two radial bolts or abutments 127. The inner collar 6 is then pushed, by pressing on the milled push button 7, as far as possible into the pipette body so that the piston 24 is in the discharge position (lower end position). In this discharge position of the piston 24, the pipette tip 107 is pushed over the piston 24 so far upwardly that the inner surface of the converging end region 101 of the pipette tip 107 sits snugly against the lower surface 123 of the piston 24. As this pushing occurs, the holding ring 105 is also displaced and then fixed in this displaced position by operation of an eccentric arrangement illustrated in FIG. 7. In this way, the pipette tip 107 is locked in a position in which no dead volume remains when the piston 24 is in the discharge position. Thus, this adjustment of the holding ring 105 with the attached pipette tip 107 ensures the complete discharge of liquid which has been drawn in.

The structure now to be described with reference to FIGS. 4, 4*a*, 5 and 6 is disclosed and claimed in Franke et al. U.S. Pat. No. 4,084,730 assigned to the assignee of the present invention.

Figure 4:
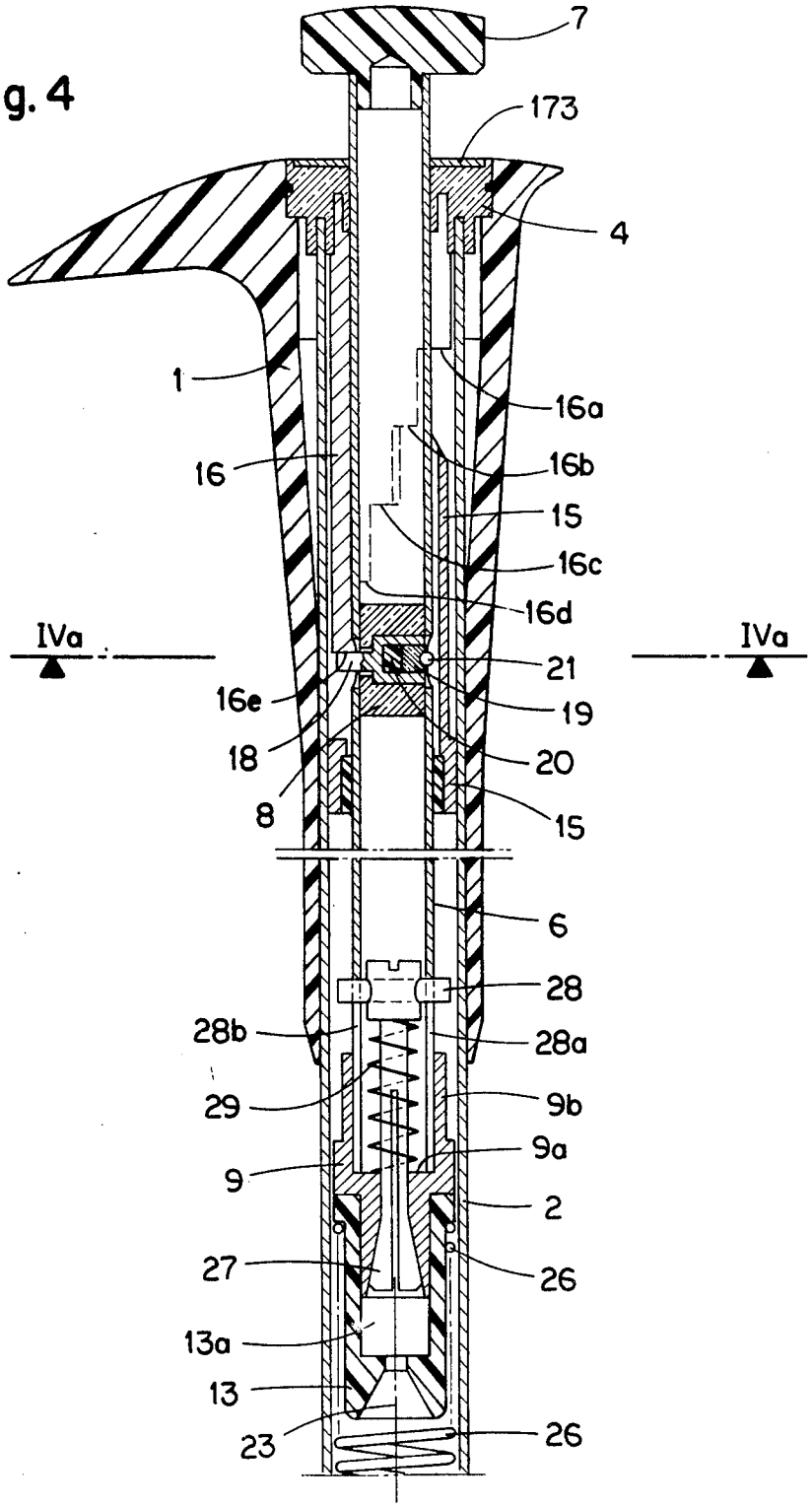
FIG. 4 is an axial section through FIG. 1 on a larger scale.

FIG. 4 shows an axial section through the embodiment of FIG. 1 on a larger scale. To the lower end of the inner collar 6, there is firmly connected a guide ring 9 which slides in the pipette housing 2 and, in this way, guides the inner collar 6 during axial movement thereof. On to the lower part of the guide ring 9 there is positioned a bush which is free to rotate with respect to collar 6 and guide ring 9 so that when the inner collar 6 is rotated, the pressure spring 26 provided therebelow is not forced to rotate. The bush 13 is preferably made of a synthetic resin, for example, polytetrafloroethylene, and has an outer, downwardly pointing annular shoulder against which the upper end of the pressure spring 26 presses, the lower end of this pressure spring being non-displaceably mounted in the pipette housing 2. Upon pressing in the inner collar 6 by means of pressure on the push button 7, the pressure spring 26 is thus compressed. Therefore, the pressure spring 26 exerts upward pressure on the inner collar 6. The lower end position, i.e., furthest discharge position, is, in the case of correct adjustment, defined by the simultaneous impingement, on the one hand, of the lower surface 123 of the piston 24 on the inner surface of the converging end region 101 of the pipette tip 107 and, on the other hand, of a stop pin 18 on a cylindrical end piece 15*a*(FIG. 6) of a half shell member 15.

For the adjustment of different pipetting volumes in the hand pipette according to the present invention, the upper end of the stroke path is adjusted since the lower end of the stroke path is, as just described, defined by the impingement of the lower surface 123 of the piston on the inner surface of the converging region 101 of the pipette tip 107. The step-shaped distance piece 16 illustrated in FIG. 4 is used for setting the upper end of the stroke path.

Figure 4A:
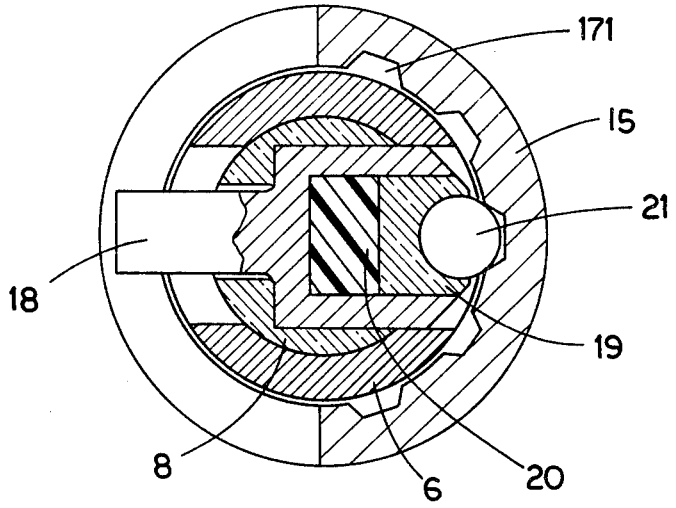
FIG. 4*a* is a section along the line IV*a*—IV*a* in FIG. 4.

FIG. 4*a* shows a section along the line IV*a*—IV*a* of FIG. 4. As can be seen, the step-shaped distance piece 16 is roughly half tube which has downwardly oriented steps 16*a*, 16*b*, 16*c*, 16*d* and 16*e*. These steps 16*a* to 16*e* are coordinated with a stop pin 18 which projects radially from the inner collar 6. In the position illustrated in FIG. 4, this stop pin 18 lies at the lowermost step 16*e* and thus limits the upper end of the stroke path to that corresponding to the smallest possible pipetting volume. If the milled push button 7 is rotated and thus the inner collar 6 is rotated through a small angle, then the stop pin 18 disengages from the step 16*e* and the pressure spring 26 presses the inner collar 6 so far upwardly that the stop pin 18 engages in the next step 16*d*. By further rotation on the milled push button 7, the further steps 16*c*, 16*b*, and finally the step 16*a* can be engaged as the upper limit of the stroke path, step 16*a* corresponding to the largest pipetting volume.

In order to ensure that an adjusted pipetting volume is not altered by accidental rotation of the inner collar 6, it is advantageous when, upon rotating the push button 7 for a changeover from one pipetting volume to another pipetting volume, a resistance must be overcome. For this purpose, the half shell 15 which mates with distance piece 16 is provided with axially extending longitudinal grooves 171, each groove lying diametrically opposite to each step. These longitudinal grooves 171 can be seen in FIG. 4*a*. Thus, in the case of five steps 16*a* to 16*e*, the half shell 15 has five inner longitudinal grooves 171.

Figure 10:
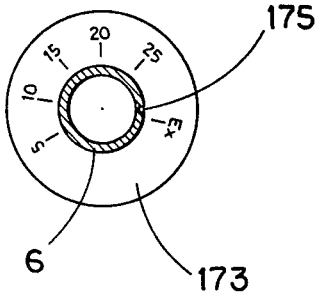
FIG. 10 is a section along the line XVIII—XVIII through the embodiment of FIG. 9.

As can be seen from FIG. 4*a*, a strengthening bolt 8 is glued into the interior of the inner collar 6, the inner collar 6 and the strengthening bolt 8 having a transverse bore are glued to the stop pin 18, a ball holder 19 and the pressure piece 20 made of elastic material. The pressure piece 20 presses the ball 21 elastically into one of the longitudinal grooves 171 of the half shell 15. When the inner collar 6 is rotated by radial movement of the push button 7, then the spring-mounted ball 21 engages or detents into one of the longitudinal groove 171 of the half shell 15 at which the rotary movement stops. Each longitudinal groove 171 is coordinated with a step of the distance piece 16, which step defines a pipetting volume and is correspondingly inscribed on a scale 173 (see FIG. 10) on the end piece 4. The inner collar 6 carries a marking 175 on its shaft projecting from the end piece 4. If this marking 175 stands on a value of the scale 173, then the pipetting volume in question is adjusted. The ball 21 rolls or slides, when carrying out a stroke movement, in the longitudinal groove 171 of the half shell 15 corresponding to the pipetting volume and step in question. When rotating the milled push button 7 and thus the inner collar 6, the ball 21 must overcome the resistance between two neighbouring longitudinal grooves 171 formed by the part therebetween and thereby compresses the elastic material 20. An unintentional passing over from one pipetting volume to another pipetting volume is hereby prevented.

If the piston rod 23 (see FIG. 3) is to be fixed by means of a thread in the area 147, then, for example, the guide ring 9 (FIG. 6) is provided with a corresponding internal thread. An advantageous ejection mechanism which is an alternate to the threaded connection is illustrated in FIG. 4 and is described hereinafter in detail with reference to FIGS. 5 and 6.

Figure 6:
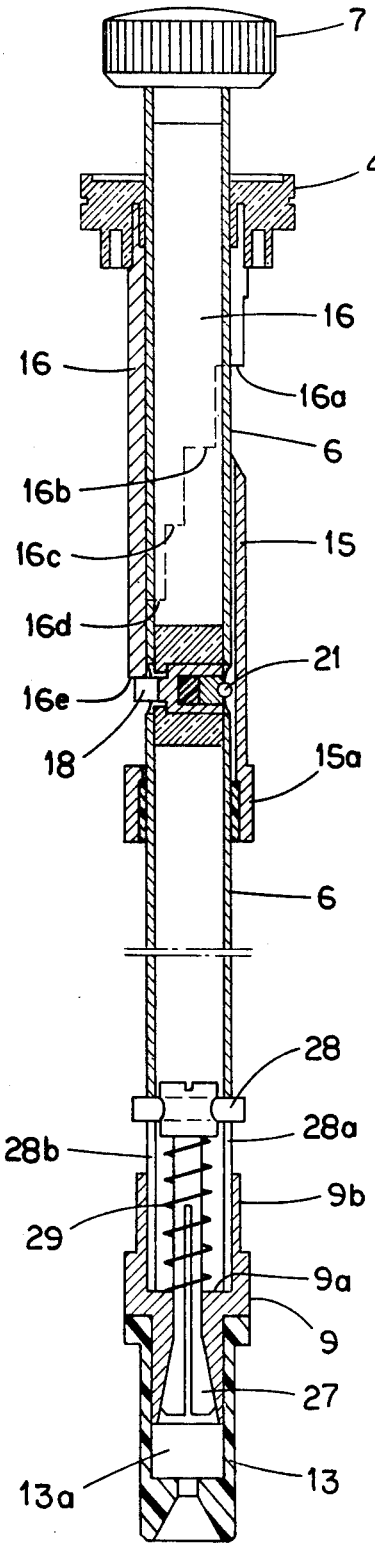
FIG. 6 is the embodiment shown in FIG. 5 in a gripping position and rotated through an angle of 90° about the longitudinal axis and in axial longitudinal section.

FIG. 6 shows a collet 27 in the closed position in which it firmly holds the piston rod (not illustrated). FIG. 5 shows the embodiment of FIG. 6 in a position rotated through an angle of 90°; in FIG. 5 the collet 27 can be seen in the opened position in which it frees the piston rod. According to FIG. 6, the collet 27 is pressed together by the guide ring 9 which surrounds it in the manner of a tube so that the piston rod is clampingly encompassed. The upper end pieces 9*b* of the guide ring is glued on to the lower end of the inner collar 6 which is provided with slots 28*a* and 28*b*. When the inner collar 6 is pulled upwardly over all of the steps limiting the various stroke volumes, then the stop pin 18 reaches an upper end position in which it can be locked by a further small rotation in the manner of a bayonet connection (see FIG. 5). In this locked position, displacement in an axial direction is impossible.

Transversely through the upper end of the collet 27 there is inserted a stop pin 28. This is guided axially displaceably in the two diametrically opposite slots 28*a* and 28*b* of the lower end of the inner collar 6. These slots are indicated in view in FIG. 5 and can be seen in section in FIG. 6.

Figure 5:
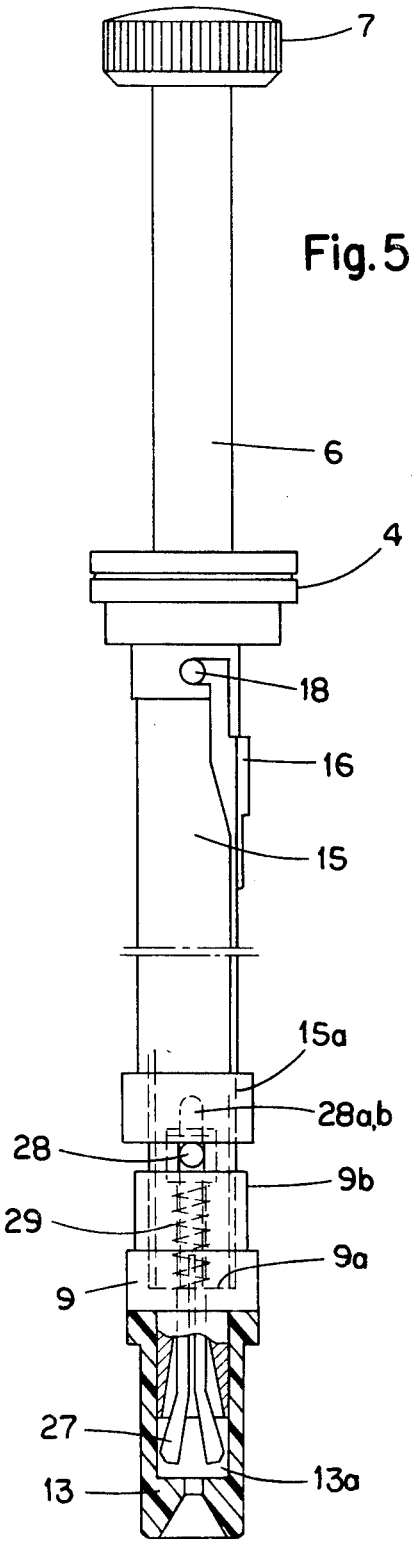
FIG. 5 shows the opened gripping and rejecting mechanism for a piston rod in plane view and partly in section.

When the inner collar 6 is pulled upwardly into the position illustrated in FIG. 5, then, the stop pin 18 moves upwardly, as does the inner collar 6 which takes upwardly with it the guide ring 9, which is firmly connected therewith which ring 9 rotatably carries the bush 13.

To the stationary pipette housing 2 (FIG. 4) there is firmly connected, through the inserted end piece 4, the half shell 15, the cylindrical end piece 15*a* of which surrounds the inner collar 6. On this fixed cylindrical end piece 15*a* of the half shell 15 impinge the ends of the stop pin 28 projecting out of the inner collar when the inner collar is pulled upwardly to its position of FIG. 5. Against the elastic force of a spring 29, the stop pin 28 is pushed downwardly by the half shell 15, the pin 28 being displaceable downwardly relatively to the inner collar 6 into the slots 28*a* and 28*b* from the upper ends of these slots (cf. also FIG. 4). In this way, the stop in 28 compresses the spring 29 against the stop 9*a* of the guide ring 9. The stop pin 28 is firmly connected with collet 27 so that, with the stop pin 28, the collet 27 is also firmly held by the half shell 15. Relatively to the collet 27, the guide ring 9 and the bush 13 move upwardly so that a hollow space 13*a* of the bush 13 receives the lower end of the collet 27 and permits, because of its elasticity, the collet 27 (consisting of three fingers) to open and free the piston rod 23 so that this can freely drop out. In this manner, the piston unit can be ejected without the piston having to be touched; for hygienic reasons, such an ejection after the conclusion of a pipetting operation can be preferable to removal of the piston by screwing out of the member 9, the previously mentioned alternate construction.

If, through the lower central opening 145 (see FIG. 1) of the holding ring 105, a new piston unit (see FIG. 3) is pushed into the hand pipette, then this new piston unit is fixed by turning back the milled push button 7 to the left from the locked position illustrated in FIG. 5 and then the inner collar 6 is axially displaced to such an extent that the first step 16*a* is reached and thus the largest pipetting volume is adjusted. In the case of rotating to this first step 16*a*, the ball 21 must engage into that longitudinal groove 171 which corresponds to the maximum stroke volume. In the case of pushing the inner collar 6 downwards, the half shell 15 moves relatively upwardly, i.e. from the position of FIG. 5 into the position of FIG. 6. The stop pin 28 is hereby pushed upwardly by the spring 29 up to the upper end of the slots 28*a* and 28*b* and, at the same time, the collet 27 is drawn into the guide ring 9 and is thus closed. The upper end of the piston rod 23 is then firmly clamped in the collet 27.

Figure 8:
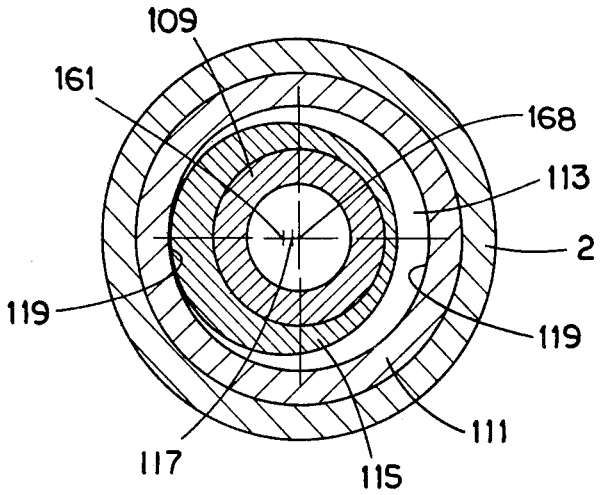
FIG. 8 is a section along the line VII*a*—VII*a* in the embodiment of FIG. 7.
Figure 9:
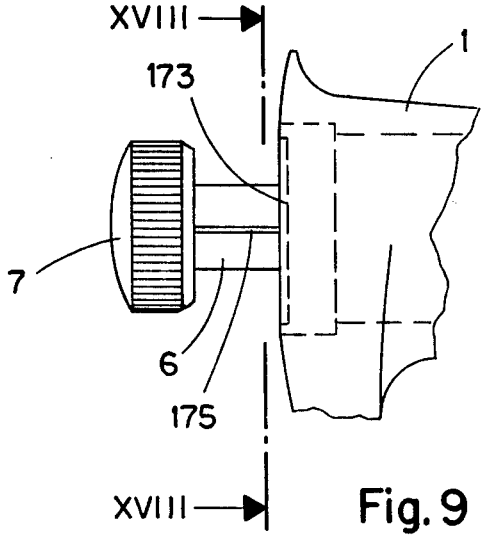
FIG. 9 is a view of the uppermost part of the hand pipette.
Figure 7:
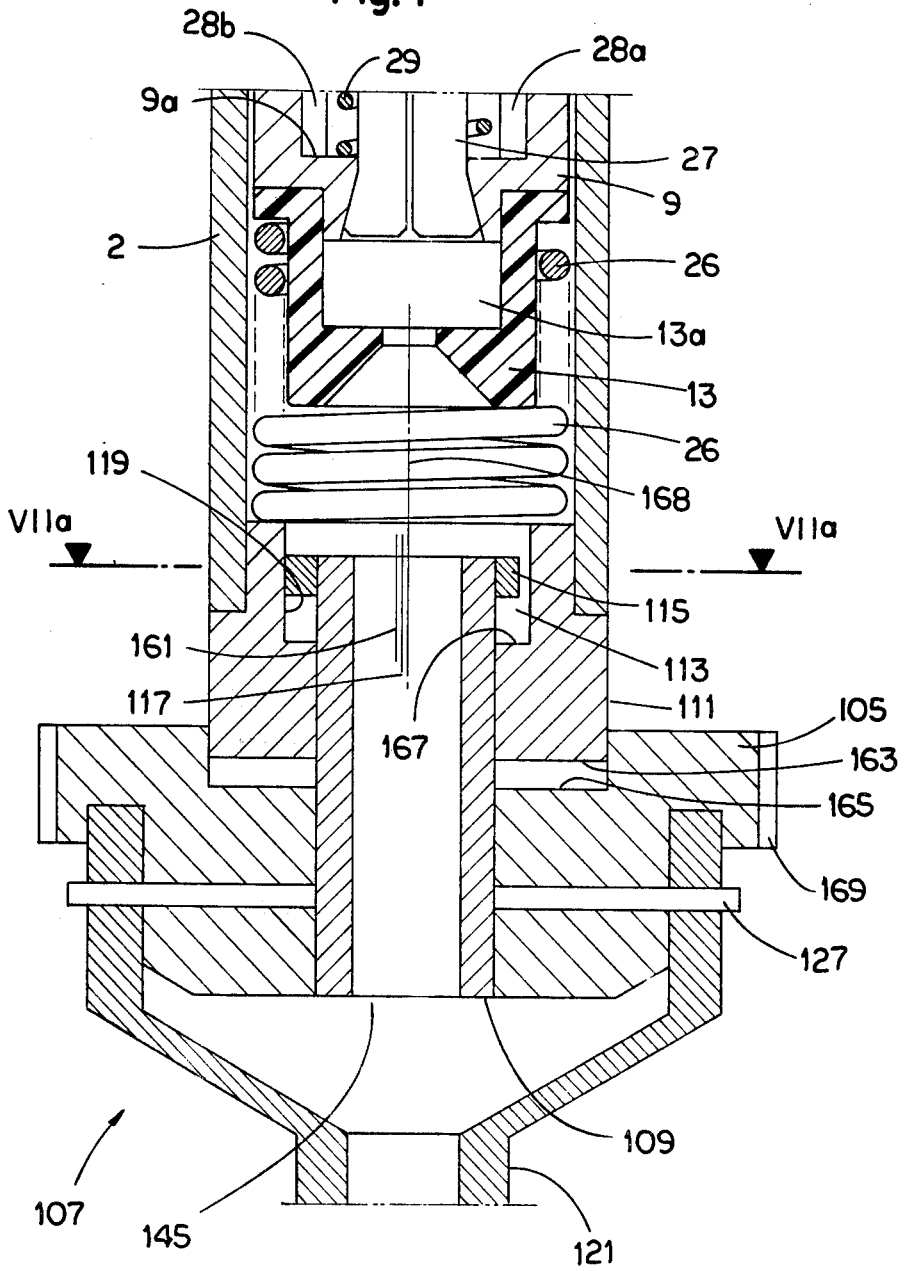
FIG. 7 is an axial section on a larger scale through the axially displaceable and lockable arrangement of the holding ring in the receiver.

The clamping and locking structure now to be described in detail with reference to FIG. 7 and 8 is not disclosed in the above mentioned Franke et al. U.S. Pat. No. 4,084,730.

FIG. 7 shows the axially displaceable and lockable mounting of the holding ring 105 in the reception end 111 of the pipette housing 2. The scale of FIG. 7 is larger than that of FIG. 1, furthermore, for illustrative purposes enlargement is greater in the radial direction than in the axial direction.

The holding ring 105 also has the central opening 145, which can be seen also in FIG. 1, in which is firmly placed a tube 109. Through this tube freely extends the piston rod 23 (not illustrated in FIG. 7) which, on its lower end (see FIG. 3), carries the piston 24 which slides in the middle hollow cylindrical region 121 of the pipette tip 107. The lower reception end 111 of the pipette housing 2 ends in a cylindrical recess of the holding ring 105, the recess of the holding ring 105 being central to the axis 168 of the whole pipette arrangement so that the holding ring 105 is rotatable about this axis 168 and is displaceable in the direction thereof.

On the upper, free end of the tube 109, projecting into the reception end 111, there is fixed a circular cylindrical eccentric 115, the eccentric axis 117 of which lies somewhat outside the axis 168 of the whole arrangement. A widened circular cylindrical space 113 of the reception end 111, in which the eccentric 115 can move, has a wall 119, the axis of which is different not only from the axis 168 of the whole arrangement but also from the eccentric axis 117. As can be seen from FIG. 7, the axis 161 of the wall 119 lies further away from the axis 168 of the whole arrangement than the eccentric axis 117.

When the holding ring 105 is rotated with the help of its milled outer surface 169, then the eccentric 115 can be brought out of the clamping hold with the wall 119 surrounding it. In this position, it is possible to displace the tube 109 by means of the holding ring 105 into the corresponding bore of the reception end 111 and thus to adjust the holding ring 105 and the pipette tip 107 carried by it in such a manner with regard to the piston arrangement as has already been described with reference to FIGS. 1 and 3. In order to make possible such an adjustment, the lower end surface 163 of the tubular reception end 111 is at a certain distance from the bottom surface 165 of the holding ring 105 and, in the same way, the eccentric 115 is at a distance from the bottom surface 167 of the reception end 111 formed by an inner annular shoulder. These two distances make possible the necessary axial displacement within that region in which an adjustment is necessary. If the tube 109 is pushed so far into the reception end 111 that, on the lower surface 123 of the piston 24 standing in the discharge position, the inner surface of the converging end region 101 of the pipette tip 107 lies snugly, then the desired adjustment position is reached. In this position, the holding ring 105 is rotated in such a manner that the eccentric 115 clamps with the surrounding wall (cf. also FIG. 8). It is then ensured that, during the pipetting procedure, no axial displacement of the pipette tip can take place with would result in a change of the pipetting volume to be measured.

Figure 11:
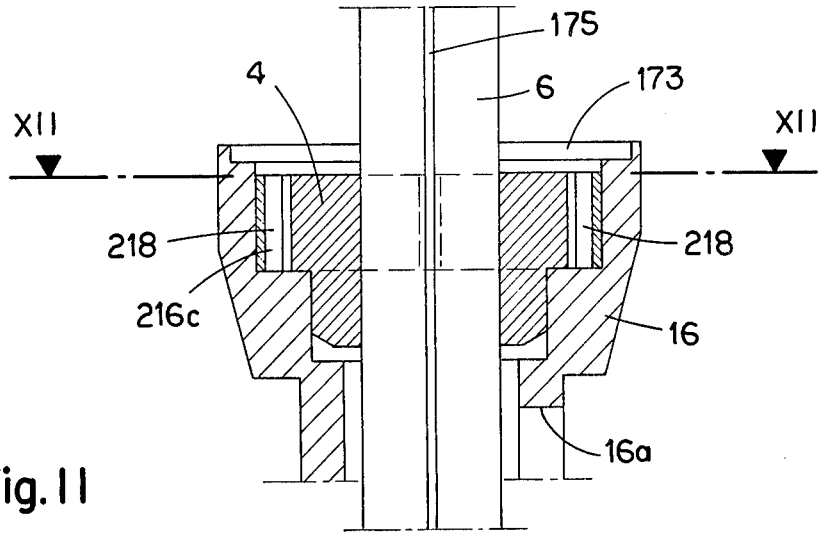
FIG. 11 is an axial section through a modified construction of the uppermost part of the hand pipette.
Figure 12:
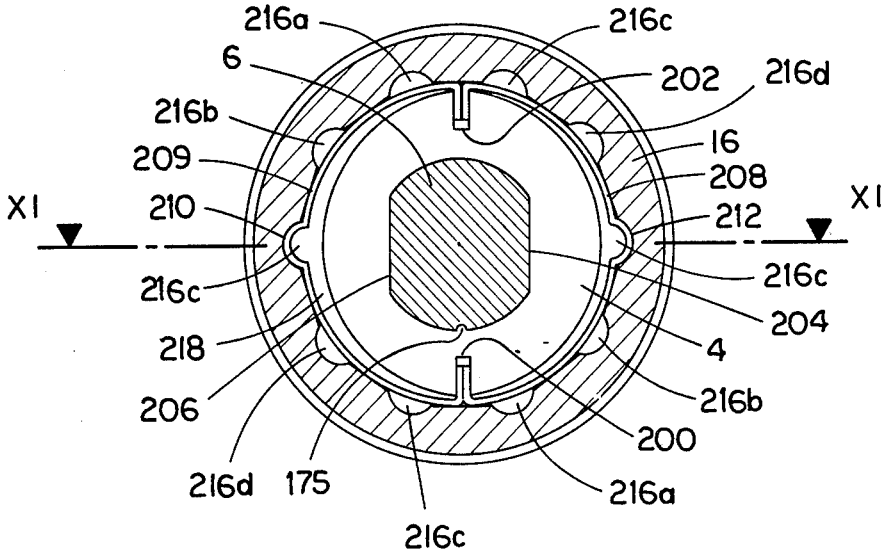
FIG. 12 is a section along the line XII—XII in the embodiment of FIG. 11.

In order to ensure that an adjusted pipetting volume is not changed by an accidental rotation of the inner collar 6, the arrangement is provided which has been described above with reference to FIG. 4*a* and disclosed in the previously mentioned U.S. Pat. No. 4,084,730. This arrangement operates satisfactorily but, nevertheless, consists of many individual parts so that production there of is relatively expensive. A simpler construction is illustrated in FIGS. 11 and 12. In the case of this construction, the distance piece 16 is constructed as a tubular body, i.e., the distance piece forms a part of the half shell 15. The longitudinal grooves are provided directly in the interior of the distance piece, in the upper region surrounding the end piece 4. The inner collar 6 is provided in its upper region with two flat surfaces 204 and 206 (FIG. 12) on which lie correspondingly flat surfaces of the end piece 4 in such a manner that the inner collar 6, upon rotation, takes with it the end piece 4 but, on the other hand, can be freely displaced longitudinally in the end piece 4.

The end piece 4 has a somewhat elliptical cross-section. It carries non-rotatably two spring leaf profiles 208 and 209, each spring leaf profile being bevelled on its long sides and having in the middle a projecting flange 212 and 210, respectively. The two spring leaf profiles encompass the end piece 4 in such a manner that together they form a somewhat tubular-shaped body. The bevelling on their long edges is such that each of two bevelled regions engage into a longitudinal slot 200 or 202, respectively, of the end piece 4. These longitudinal slots are applied to the largest diameter of the end piece 4 of elliptical cross-section so that the projections 210 and 212 are present on the smallest diamter of the end piece 4 of elliptical cross-section.

The distance piece 16 has, in the region encompassing the end piece 4, longitudinal groove pairs 216*a*, 216*b*, 216*c*, 216*d*, and 216*e* over its whole inner circumference. Diametrically opposite to each of these longitudinal grooves lies a corresponding longitudinal groove, i.e., the longitudinal groove 216*a* lies diametrically opposite to a further longitudinal groove 216*a*, the longitudinal groove 216*b* lies diametrically opposite to a longitudinal groove 216*b* and so forth. In the illustrated position, the two projections or flanges 210 and 212 are engaged in the two longitudinal grooves 216*c*. When the inner collar 6 is rotated by rotating the push button 7, this takes with it the end piece 4 because of its inner flat surfaces 204 and 206, the two spring leaf profiles 208 and 209 being rotated with the end piece 4. In this way, these spring leaf profiles are compressed, and this is accomplished because of the somewhat elliptical shape of the end piece 4, since, in the free space 218 (cf. also FIG. 11, which illustrates a section through FIG. 12 along the line XI—XI) between the end piece 4 and the spring leaf profiles, an elastic deformation can take place. In the case of a clockwise rotation, the flanges 210 and 212 reach the two longitudinal grooves 216*b* and engages therein, a larger pipetting volume thus being adjusted.

The construction of FIGS. 11 and 12 has, in comparison with the construction of FIG. 4*a*, the functional advantage that the two spring leaf proviles 208 and 209 exert the same pressure on the inner collar 6 from both sides, whereas in the case of the construction of FIG. 4*a*, the inner collar 6 is pressed on one side, the side lying opposite to the ball 21. In comparison therewith, in the case of the construction of FIGS. 10 and 11, the more uniform pressure loading of the inner collar 6 provides an easier movement.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A hand pipette having a housing with a piston therein which is forced upwardly by an elastic force, the piston being displaceable in a pipette tip removably attached at the lower reception end of the housing, the piston rod being displaceable downwardly against the elastic force by external operation to such an extent that the piston, at the lower end of the piston stroke, is at the lower end of the pipette tip, the lower end of the pipette housing being provided with a holding ring through which the piston rod passes and which carries the removable pipette tip and at its upper end is mounted so as to be axially displaceable and lockable, wherein said holding ring carries a tube which passes through an axial bore of said lower reception end of the pipette housing and is a widened space in said reception end bore, carries an eccentric with a related eccentric axis, the wall of said widened space lying eccentrically to the axis of said bore in such a manner that rotation of the holding ring brings about a clamping of the eccentric with the surrounding wall of said widened space.

2. A hand pipette according to claim 1, wherein the pipette tip is disconnectably held by means of a bayonet joint, comprising slots and radial bolts, on a lower lug of the holding ring.

3. A hand pipette according to claim 1, the piston rod of which is held in an inner collar having an upper end projecting from the pipette housing, wherein the inner collar is displaceable in a tubular distance piece with radial steps which co-operate with a radial stop pin projecting radially from the inner collar for limiting the piston stroke, the steps of the distance piece limiting the upper end of the piston stroke.

4. A hand pipette according to claim 3 in which, by rotation of the upper projecting end of the inner collar, the stop pin is associated with various steps of the distance piece, said distance piece having inner longitudinal grooves, and wherein on the inner collar is non-rotatably provided at last one outwardly spring loaded projection which engages into one of the inner longitudinal grooves of the distance piece.

5. A hand pipette according to claim 4, wherein the outwardly spring loaded projection is a ball or flange.

6. A hand pipette accordind to claim 4 or 5, wherein on the inner collar there is a non-rotatable end piece to which is non-rotatably attached a tubular body which has two diametrically opposite elastic flanges, each of which engages into one of said longitudinal grooves.

7. A hand pipette according to claim 6, wherein the tubular elastic body comprises two spring leaf profiles, the side edges of which are bevelled and engage in longitudinal slots of the end piece with the middle regions of said leaf profiles raised to form said flanges.

* * * * *